US008257095B2

(12) United States Patent
Akai et al.

(10) Patent No.: US 8,257,095 B2
(45) Date of Patent: Sep. 4, 2012

(54) CONNECTOR

(75) Inventors: Noriyuki Akai, Tokyo (JP); Naoki Takahashi, Kanagawa (JP)

(73) Assignee: Kyocera Connector Products Corporation (JP)

( * ) Notice: Subject to any disclaimer, the term of this patent is extended or adjusted under 35 U.S.C. 154(b) by 0 days.

(21) Appl. No.: 13/173,451

(22) Filed: Jun. 30, 2011

(65) Prior Publication Data

US 2012/0003875 A1 Jan. 5, 2012

(30) Foreign Application Priority Data

Jun. 30, 2010 (JP) ..... 2010-148694

(51) Int. Cl.
*H01R 12/00* (2006.01)

(52) U.S. Cl. ..... 439/74; 439/660; 439/248

(58) Field of Classification Search ..... 439/247, 439/248, 74, 660
See application file for complete search history.

(56) References Cited

U.S. PATENT DOCUMENTS 5,516,303 A * 5/1996 Yohn et al. ..... 439/248
5,556,286 A * 9/1996 Ikesugi et al. ..... 439/74
5,830,018 A * 11/1998 Simmel ..... 439/660
6,638,106 B1 * 10/2003 Wu ..... 439/567
7,198,492 B2 * 4/2007 Shichida et al. ..... 439/74
7,425,158 B2 * 9/2008 Ookura ..... 439/660
7,494,346 B1 * 2/2009 Peng ..... 439/74
7,547,236 B1 * 6/2009 Chen ..... 439/660
7,637,762 B2 * 12/2009 Uesaka ..... 439/247
7,658,636 B2 * 2/2010 Takeuchi et al. ..... 439/357
7,748,994 B1 * 7/2010 Peng et al. ..... 439/74
7,862,345 B2 * 1/2011 Fukazawa et al. ..... 439/74
2004/0175971 A1 * 9/2004 Terashima et al. ..... 439/83
2005/0009379 A1 * 1/2005 Huang et al. ..... 439/65
2007/0173131 A1 * 7/2007 Chen ..... 439/660
2011/0294326 A1 * 12/2011 Tanaka et al. ..... 439/248

* cited by examiner

*Primary Examiner* — Briggitte R Hammond
(74) *Attorney, Agent, or Firm* — McCormick, Paulding & Huber LLP

(57) ABSTRACT

A connector having a plug connector and a receptacle connector, one of which includes a first fixed insulator, first contacts aligned in a first direction orthogonal to a connecting/disconnecting direction and each including a first resiliently deformable portion deformable in a second direction orthogonal to the connecting/disconnecting direction and the first direction, a first movable insulator supported by the first contacts, and partition walls on the first fixed insulator and/or the first movable insulator. The other of the plug connector and the receptacle connector includes a second fixed insulator, second contacts aligned in the first direction, each including a second resiliently deformable portion deformable in the first direction and contactable with one first contact, and a second movable insulator supported by the second contacts and engaged with the first movable insulator when the first and second contacts come in contact with each other.

6 Claims, 10 Drawing Sheets

CONNECTOR

CROSS REFERENCE TO RELATED APPLICATION

The present invention is related to and claims priority of the following co-pending application, namely, Japanese Patent Application No. 2010-148694 filed on Jun. 30, 2010.

BACKGROUND OF THE INVENTION

1. Field of the Invention

The present invention relates to a connector equipped with a plug connector and a receptacle connector which are capable of being connected and disconnected to and from each other. Even when the plug connector and the receptacle connector are brought into engagement with each other with some amount of positional deviation therebetween, the connector absorbs this positional deviation to thereby enable the plug connector and the receptacle connector to be electrically connected to each other with reliability.

2. Description of the Prior Art

This type of connector is usually called a "floating connector", and conventional floating connectors are disclosed in, e.g., Japanese unexamined patent application publications Nos. 2007-18785 and 2007-220327.

One of the plug connector and the receptacle connector includes a first fixed insulator, a set of first contacts and a first movable insulator. The set of first contacts are cantilevered by the first fixed insulator in a state of being aligned in a direction orthogonal to a linear approaching/retreating direction (linear connecting/disconnecting direction) in which the plug connector and the receptacle connector are connected and disconnected to and from each other, and the first movable insulator is supported by the free end of each first contact. Each first contact includes a resiliently deformable portion capable of being resiliently deformed in two axial directions: the aforementioned orthogonal direction and a direction orthogonal to both the linear approaching/retreating direction and the aforementioned orthogonal direction. On the other hand, the other of the plug connector and the receptacle connector includes a second fixed insulator and a set of second contacts that are supported by the second fixed insulator in a state of being aligned in one direction.

The plug connector and the receptacle connector of the connector which are separate from each other can be connected together by being linearly moved toward each other along the linear approaching/retreating direction with the center axes of the plug connector and the receptacle connector coincident with each other. Upon connection of the plug connector and the receptacle connector to each other, the set of first contacts and the set of second contacts respectively come in contact with each other while the first movable insulator and the second fixed insulator are connected (engaged) with each other.

In addition, the plug connector and the receptacle connector of the connector can be connected to each other even when moved toward each other along the aforementioned linear engaging/disengaging direction with the center axes of the plug connector and the receptacle connector deviating from each other by some degree. More specifically, in this case, if the first movable insulator and the second fixed insulator come in contact with each other with the axes thereof misaligned, a resilient deformation of the resiliently deformable portion of each first contact causes the first movable insulator to move slightly to a position where the first movable insulator becomes coaxial with the second fixed insulator, and subsequently the plug connector and the receptacle connector are engaged with each other after the first movable insulator and the second fixed insulator become coaxial with each other.

Recently, there has been a demand for high speed transmission compatibility even with floating connectors in response to the increase in the volume of information handled by electronic equipment and an increase in communication speed of such electronic equipment.

Since the aforementioned one of the plug connector and the receptacle connector is structured to allow the resiliently deformable portion of each first contact to be resiliently deformed in the aforementioned two axial directions, spaces (clearances), which allow the aforementioned resiliently deformable portions of the set of first contacts to be resiliently deformed in the aforementioned orthogonal direction, need to be provided at portions of the first fixed insulator and at the first movable insulator adjacent to the resiliently deformable portions. Accordingly, in the first fixed insulator and the first movable insulator of the related art, a space (groove) extending in the aforementioned orthogonal direction is formed, and the resiliently deformable portion of each first contact is positioned in this space. This space has been conventionally indispensable to meet the recent market demand for the contact pitch to be small and for the tolerance of deviation (positional deviation) between the center axes of the plug connector and the receptacle connector to be large.

However, if the aforementioned space that allows the resiliently deformable portion of each first contact to be resiliently deformed is formed on the first fixed insulator and the first movable insulator, no material exists between adjacent first contacts, so that the relative permittivity is fixed at 1, which makes it difficult to adjust the impedance of adjacent first contacts.

Additionally, since the resiliently deformable portion of each first contact is an element deformable in at least two axial directions, the resiliently deformable portion of each first contact is required to be reduced in cross sectional area so as to have satisfactory resiliency. However, for instance, the electrical resistance of the conductor increases as the resiliently deformable portion is reduced in cross sectional area, which is unfavorable with respect to transmission characteristics.

For this reason, in the connector having the above described structure, it is difficult to improve the transmission characteristics of the set of first contacts.

SUMMARY OF THE INVENTION

The present invention provides a connector having improved transmission characteristics while absorbing any positional deviation between the plug connector and the receptacle connector in two axial directions orthogonal to each other.

According to an aspect of the present invention, a connector is provided, having a plug connector and a receptacle connector which are connected to and disconnected from each other by linearly moving the plug connector and the receptacle connector toward and away from each other along an approaching/retreating direction, respectively. One of the plug connector and the receptacle connector includes a first fixed insulator, first contacts which are cantilevered by the first fixed insulator in a state of being aligned in a first direction orthogonal to the approaching/retreating direction and each of which includes a first resiliently deformable portion deformable in a second direction orthogonal to both the approaching/retreating direction and the first direction, a first movable insulator supported by free ends of the first contacts, and partition walls formed on at least one of the first fixed insulator and the first movable insulator to be positioned between adjacent the first resiliently deformable portions of the first contacts. The other of the plug connector and the receptacle connector includes a second fixed insulator, second contacts which are cantilevered by the second fixed insulator in a state of being aligned in the first direction, each of which includes a second resiliently deformable portion that is deformable in the first direction and is contactable with associated one of the first contacts, and a second movable insulator which is supported by free ends of the second contacts and engaged with the first movable insulator when the first contacts and the second contacts come in contact with each other.

It is desirable for the partition walls to prevent adjacent first resiliently deformable portions from being resiliently deformed in the first direction.

It is desirable for the second contacts to be each formed by stamping out sheet metal, and for the second resiliently deformable portion of each of the second contacts to be resiliently deformable in the sheet-metal thickness direction thereof.

It is desirable for the first contacts to be each formed by stamping out a sheet metal, and for the first resiliently deformable portion of each of the first contacts to be resiliently deformable in the sheet-metal thickness direction thereof.

If the first contacts and the second contacts are made to have such structures, the first resiliently deformable portion and the second resiliently deformable portion can be made to be easily deformable.

It is desirable for the second contacts to be each formed by stamping out sheet metal, and for the resilient contact portions, which are formed on the second contacts and come into contact with contact portions formed on the first contacts when the first movable insulator and the second movable insulator are engaged with each other, to be resiliently deformable in a direction orthogonal to the sheet-metal thickness direction thereof.

It is desirable for the contact portions, which are formed on the first contacts and come into contact with the resilient contact portions of the second contacts when the first movable insulator and the second movable insulator are engaged with each other, to be greater in width than the resilient contact portions, respectively.

With this structure, even if a positional deviation occurs between the plug connector and the receptacle connector in one direction (the direction of alignment of the first contacts), the contact portions of the first contacts and the resilient contact portions of the second contacts can be made to be electrically connected to each other with reliability.

According to the present invention, a positional deviation between the first fixed insulator and the first movable insulator in a direction orthogonal to both the approaching/retreating direction and the direction of alignment of the first contacts (one direction) is absorbed by the first resiliently deformable portions of the first contacts, and a positional deviation between the first fixed insulator and the first movable insulator in the aforementioned one direction is absorbed by the second resiliently deformable portions of the second contacts.

Since the direction of absorption of the positional deviation of one of the plug connector and the receptacle connector is limited to one axial direction, the partition walls, which limit resilient deformation of the first resiliently deformable portions of the first contacts in one direction (being a major cause of fluctuations in impedance upon occurrence of positional deviation) and which are higher in relative permittivity than air (the relative permittivity thereof=1), can be installed in the first fixed insulator and the first movable insulator. Therefore, the impedance can be adjusted easily by, e.g., optimization (design change) of the spacing between each first contact and the adjacent partition wall and the shape of each partition wall; moreover, the impedance can be easily stabilized even when a positional deviation occurs between the plug connector and the receptacle connector.

Furthermore, since the first resiliently deformable portions of the first contacts only need to be resiliently deformed in one axial direction, it is possible to increase the cross sectional area of the first resiliently deformable portion of each first contact to be greater than that in a conventional structure in which a resiliently deformable portion of each contact is resiliently deformable in two axial directions. This makes it possible to achieve a reduction in electrical resistance of the conductor of each contact, thus making it possible to improve the transmission characteristics.

BRIEF DESCRIPTION OF THE DRAWINGS

The present invention will be discussed below in detail with reference to the accompanying drawings, in which.

DESCRIPTION OF THE PREFERRED EMBODIMENTS

Figure 1:
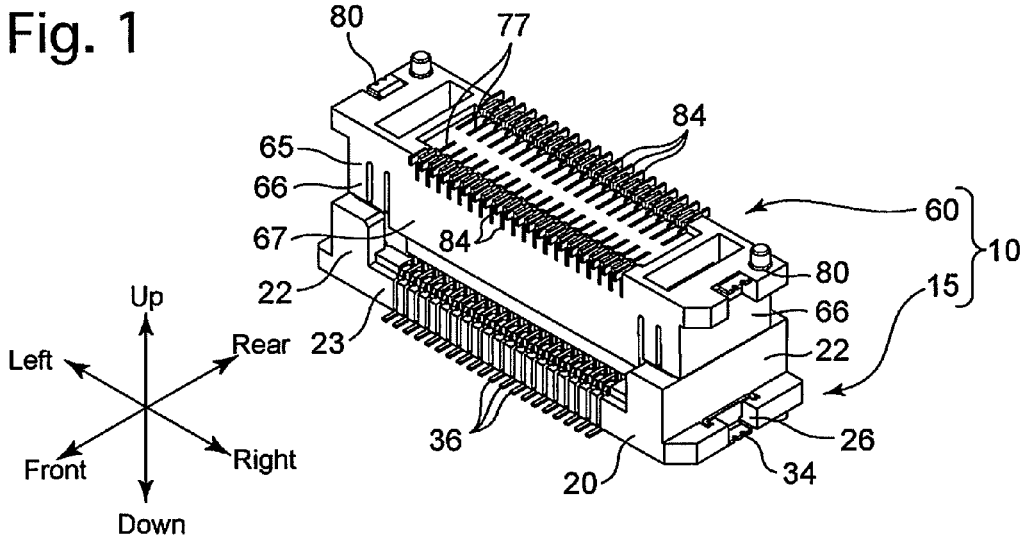
FIG. 1 is a top perspective view of an embodiment of a connector according to the present invention which includes a plug connector and a receptacle connector, showing the connector in a connected state.

An embodiment of a connector according to the present invention will be hereinafter discussed with reference to FIGS. 1 through 22. In the following descriptions, forward and rearward directions, leftward and rightward directions, and upward and downward directions (vertical direction) of the connector 10 are determined with reference to the directions of the double-headed arrows shown in the drawings.

As shown in FIGS. 1 through 3, and 19 through 21, the connector 10 is provided with a plug connector (plug) 15 and a receptacle connector (receptacle) 60 which can be connected and disconnected to and from each other.

First, the detailed structure of the plug connector 15 will be hereinafter discussed with reference mainly to FIGS. 4 through 14.

The plug connector 15 is provided with a fixed insulator 20, a pair of (left and right) fixing fittings 33, a large number of plug contacts (first contacts/second contacts) 35 and a movable insulator 42 as relatively large elements of the plug connector 15.

The fixed insulator (first fixed insulator/second fixed insulator) 20 is an integrally-molded element which is molded of an insulating and heat-resistant synthetic resin by injection molding. The fixed insulator 20 is in the shape of a box having an open top. The fixed insulator 20 is provided with a flat bottom plate 21, two support walls 22, a front wall 23 and a rear wall 24. Each support wall 22 is in the shape of a substantially letter U as viewed in plan view and the two support walls 22 constitute both ends of the fixed insulator 20 in the leftward/rightward direction. The front wall 23 and the rear wall 24 are smaller in height than the two support walls 22. The fixed insulator 20 is provided, between the bottom plate 21 and the lower ends of the left and right support walls 22, with left and right bottom through holes 25. The left and right support walls 22 are provided on outer sides thereof with left and right fitting fixing holes 26, respectively, and are further provided on inner sides of the left and right support walls 22 with left and right engaging lugs 27, respectively. Each of the front wall 23 and the rear wall 24 is provided, on the front, top and rear surfaces thereof (except the left and right ends thereof), with a plurality of contact support grooves 29 which are formed at regular pitches (intervals) in the leftward/rightward direction, and each of which is in the shape of an inverted letter U in cross section. Portions of the outer sides of the front wall 23 and the rear wall 24 which are positioned adjacently between the plurality of contact support grooves 29 are formed as outer partition walls 30, and portions of the inner sides of the front wall 23 and the rear wall 24 which are positioned adjacently between the plurality of contact support grooves 29 are formed as inner partition walls 31 which are greater in length in the forward/rearward direction than the outer partition walls 30.

The left and right fixing fittings 33 are press-formed products that are formed out of sheet metal (conductive material). Each fixing fitting 33 is provided at the lower end thereof with a tail-shaped lug 34 which extends substantially horizontally.

Figure 7:
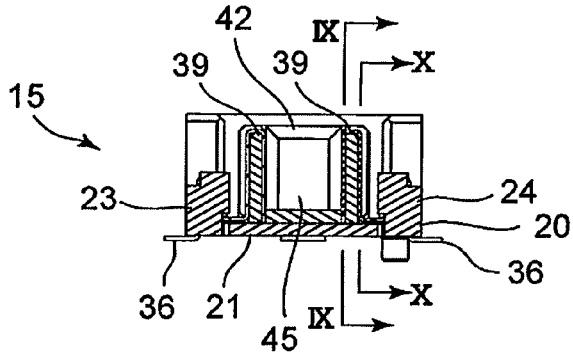
FIG. 7 is a cross sectional view taken along the VII-VII lines shown in FIG. 6, viewed in the direction of the appended arrows.

The left and right fixing fittings 33 are fixedly fitted into the left and right fitting fixing holes 26 of the fixed insulator 20, respectively, and the tail-shaped lugs 34 are positioned slightly below the bottom of the fixed insulator 20 as shown in FIG. 7.

The plurality of plug contacts 35, which are identical in number to the plurality of contact support grooves 29, are each formed from a thin base material made of a resilient copper alloy (e.g., phosphor bronze, beryllium copper or titanium copper) or a resilient Corson-copper alloy and formed into the shape shown in the drawings by being bent in the direction of thickness of the thin base material after press forming (stamping) is performed thereon, and is firstly nickel plated, as a base plating, and is subsequently gold plated, as a finish plating. As shown in the drawings, the plurality of plug contacts 35 are composed of two rows (front and rear rows) aligned in the leftward/rightward direction (one direction). The front row of plug contacts 35 and the rear row of plug contacts 35 are symmetrically arranged with respect to the forward/rearward direction.

Figure 13:
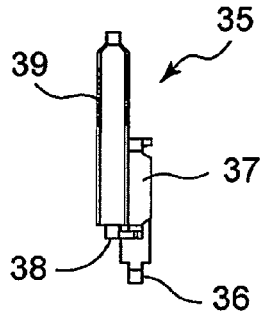
FIG. 13 is a front elevational view of the plug contact shown in FIG. 12, viewed in the direction of the arrow XIII shown in FIG. 12.
Figure 14:
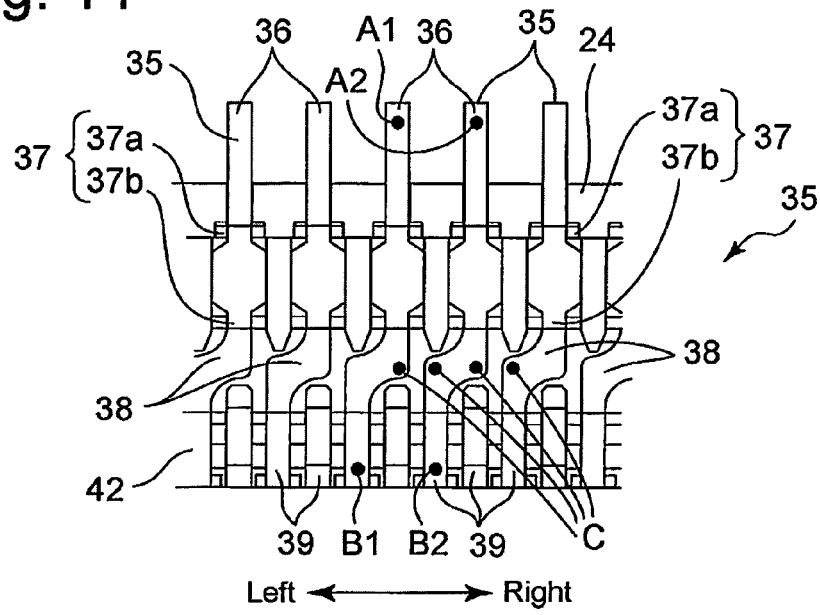
FIG. 14 is an enlarged plan view of a portion of the plug connector, showing a fixed insulator, a movable insulator and plug contacts of the plug connector.
Figure 15:
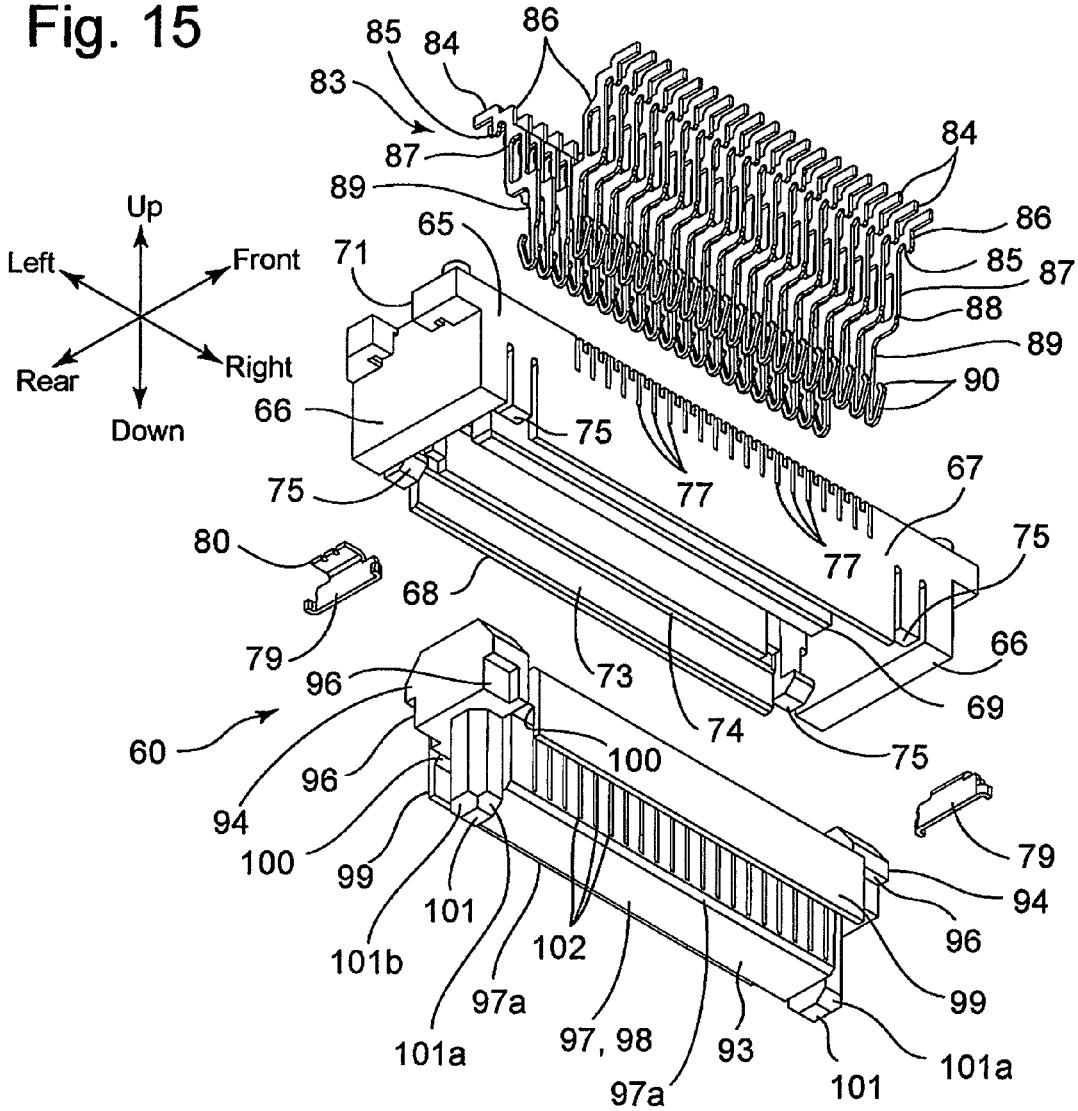
FIG. 15 is an exploded bottom perspective view of the receptacle connector of the connector.
Figure 16:
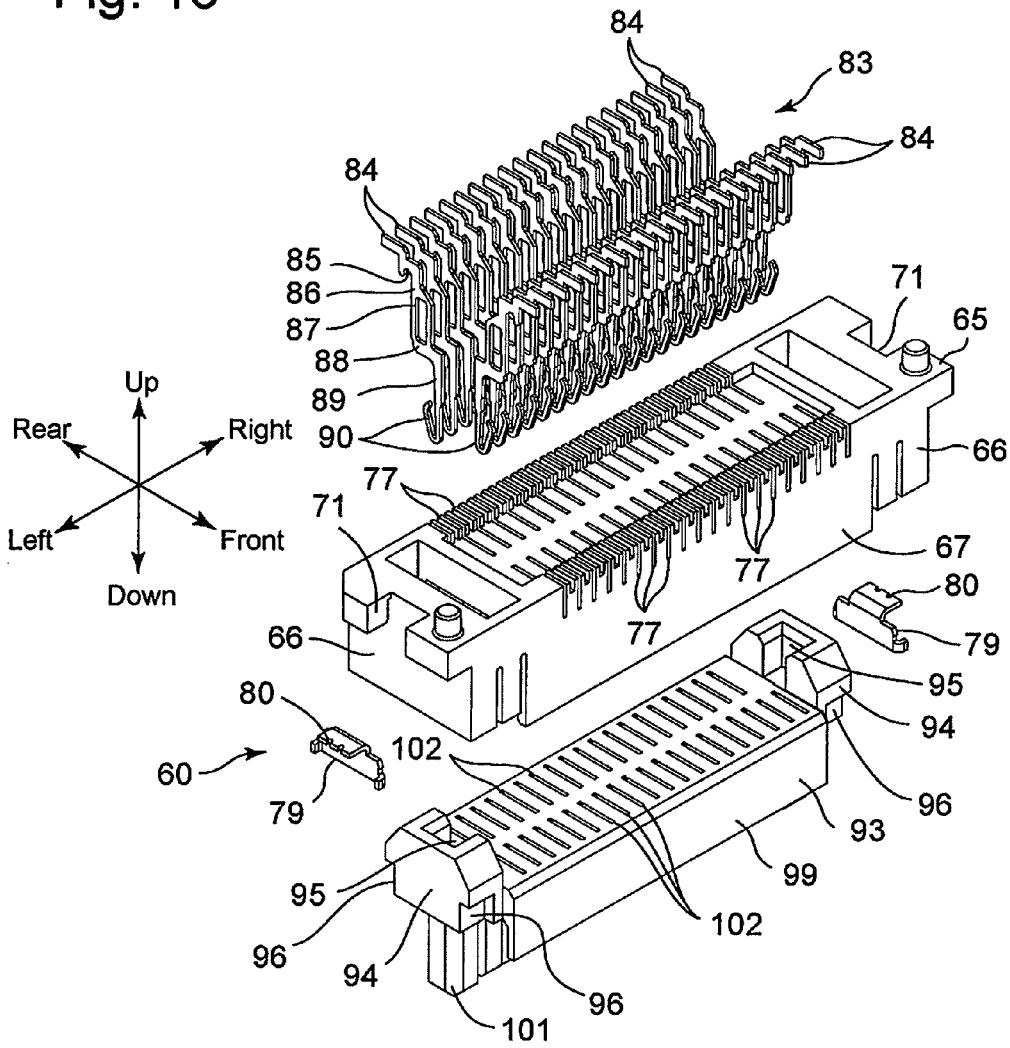
FIG. 16 is an exploded top perspective view of the receptacle connector of the connector.
Figure 17:
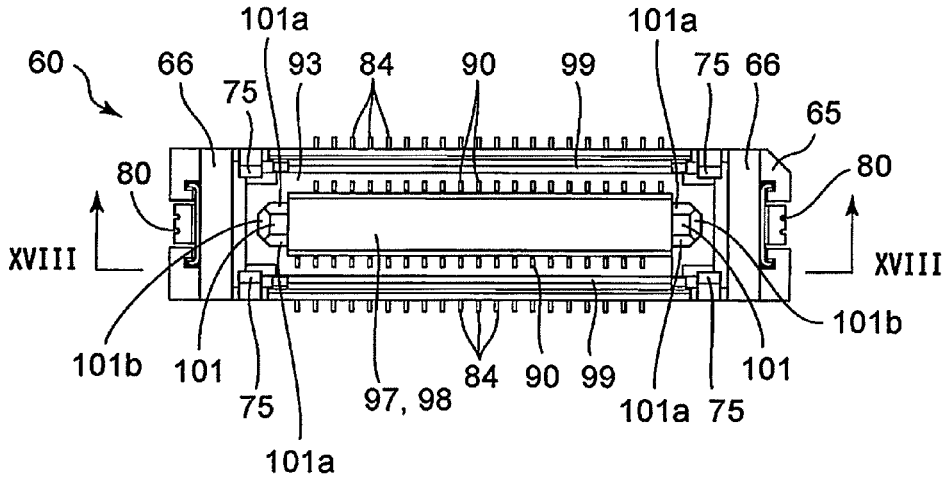
FIG. 17 is a bottom view of the receptacle connector of the connector.

Each plug contact 35 is provided at an outer end thereof with a tail-shaped end portion 36 and is further provided with a fixed-side terminal portion 37, an intermediate horizontal portion 38 and a support-side terminal portion 39. The tail-shaped end portion 36 extends substantially horizontally. The fixed-side terminal portion 37 is continuous with the inner end of the tail-shaped end portion 36 and formed into the shape of a substantially inverted letter U as viewed from a side of the fixed-side terminal portion 37. The intermediate horizontal portion 38 extends inwardly and substantially horizontally from an inner end of the fixed-side terminal portion 37. The support-side terminal portion 39 is continuous with the inner end of the intermediate horizontal portion 38 and is formed into the shape of a substantially inverted letter U as viewed from a side of the support-side terminal portion 39. As shown in FIGS. 13 and 14, the intermediate horizontal portion 38 extends inwardly (downwardly with respect to FIG. 14) from the fixed-side terminal portion 37 after once bending leftward, and therefore, the positions of the fixed-side terminal portion 37 and the support-side terminal portion 39 of each plug contact 35 deviate from each other in the leftward/rightward direction as viewed from the front. In addition, as clearly shown in FIGS. 12 and 13, the upper end of the support-side terminal portion 39 is positioned higher than the upper end of the fixed-side terminal portion 37 in the vertical direction.

The movable insulator (first movable insulator/second movable insulator) 42 is an integrally-molded element which is molded of an insulating and heat-resistant synthetic resin by injection molding. The movable insulator 42 is in the shape of a substantially rectangular parallelepiped and has dimensions so that the movable insulator 42 is allowed to be accommodated with clearance in the internal space of the fixed insulator 20.

The movable insulator 42 is provided at both ends thereof in the leftward/rightward direction with two (left and right) side deformable portions 43 which extend downwardly from the upper ends of the both ends of the movable insulator 42 to be elastically deformable in the leftward/rightward direction, respectively. Each side deformable portion 43 is provided with an engaging hole (through-hole) 44.

The movable insulator 42 is provided on top thereof with a receiving recess 45 which is recessed downwardly, and is further provided on the front and rear sides of the receiving recess 45 with a front wall 46 and a rear wall 47, respectively. Each of the front wall 46 and the rear wall 47 is provided, on the front, top and rear surfaces thereof except the left and right ends of each of the front wall 46 and the rear wall 47, with a plurality of contact support grooves 48 which are formed at the same pitches (intervals) as the plurality of contact support grooves 29 in the leftward/rightward direction and each of which is in the shape of an inverted letter U in cross section. Portions of the outer side surfaces of the front wall 46 and the rear wall 47 which are positioned between the adjacent contact support grooves 48 are formed as outer partition walls 49, and portions of the inner side surfaces of the front wall 46 and the rear wall 47 which are positioned between the adjacent contact support grooves 48 are formed as inner partition walls 50.

Additionally, the movable insulator 42 is provided, in the bottom thereof in the vicinity of the left and right ends of the movable insulator 42, with a pair of (left and right) engaging holes 51 (see FIG. 5) through which the internal and external spaces of the movable insulator 42 are communicatively connected to each other.

The fixed insulator 20, to which the two fixing fittings 33 are integrally fixed, the plug contacts 35 and the movable insulator 42 are assembled together in a procedure which will be discussed hereinafter.

First, the movable insulator 42 is inserted into the fixed insulator 20 with the bottom plate 21 of the fixed insulator 20 and a bottom surface 42*a* of the movable insulator 42 facing each other. Thereupon, the left and right side deformable portions 43 override the left and right engaging lugs 27 while being resiliently deformed so that the left and right engaging lugs 27 are engaged in the engaging holes 44 of the left and right side deformable portions 43, respectively. This engagement of the engaging lugs 27 with the engaging holes 44 prevents the movable insulator 42 from moving vertically in the fixed insulator 20. In addition, the engagement of each side deformable portion 43 with an inner surface of the adjacent support wall 22 prevents the movable insulator 42 from moving in the leftward/rightward direction in the fixed insulator 20. However, a slight clearance that does not adversely effect the assembly efficiency is provided between each side deformable portion 43 and the inner surface of the adjacent support wall 22. The dimensions of each engaging lug 27 and each engaging hole 44 in the forward/rearward direction are set so as to allow the movable insulator 42 to move in the forward and rearward direction in the fixed insulator 20.

Subsequently, the fixed insulator 20 is mounted on an assembling jig (not shown), on which guide pins corresponding to the two bottom through holes 25 and the two engaging holes 51 are formed. Thereupon, the guide pins of the assembling jig are engaged in the two bottom through holes 25 and the two engaging holes 51, so that the movable insulator 42 is held by the fixed insulator 20 via the guide pins in an immovable state with respect to the fixed insulator 20.

In this state, the support-side terminal portions 39 of the plurality of plug contacts 35 are brought into engagement with the plurality of contact support grooves 48 of the movable insulator 42 from above, respectively. Thereupon, the inner and outer portions (contact portions) of each support-side terminal portion 39 are engaged with inner and outer side surfaces in the associated contact support groove 48, respectively. At this time, one or more minute detents (not shown) formed on a side of at least one of the inner and outer portions of each support-side terminal portion 39 wedge into an inner surface (the inner and outer partition walls 49 and 50) of the associated contact support groove 48, and consequently, each support-side terminal portion 39 is fixed to the associated contact support groove 48 therein. Additionally, at the same time, the fixed-side terminal portions 37 of the plurality of plug contacts 35 are brought into engagement in the plurality of contact support grooves 29 from above, respectively. Thereupon, an outer portion 37*a* of the fixed-side terminal portion 37 of each plug contact 35, which is continuous with the tail-shaped end portion 36 of the same plug contact 35, is engaged with an outer side surface in the associated contact support groove 29 (and comes in contact with adjacent two of the outer partition walls 30) while one or more minute detents (not shown) formed on the outer portion 37*a* of the fixed-side terminal portion 37 of each plug contact 35 wedge into an inner side surface of the associated contact support groove 29 (i.e., wedge into the outer partition wall 30), and consequently, each fixed-side terminal portion 37 is fixed to the associated contact support groove 29 therein. On the other hand, an inner portion 37*b* of the fixed-side terminal portion 37 of each plug contact 35, which is continuous with the intermediate portion 38 of the same plug contact 35, is movably engaged with an inner side surface side portion of the associated contact support groove 29 and is prevented from moving in the leftward/rightward direction by adjacent two of the inner partition walls 31. Accordingly, the plug contacts 35 are cantilevered by the fixed insulator 20 via the fixed-side terminal portions 37 and the associated contact support grooves 29.

After the plug connector 15 is configured by integrating the fixed insulator 20, the plug contact 35 and the movable insulator 42 in the above described manner, and the aforementioned assembling jig is removed, the plug connector 15 and a circuit board CB1 (shown by two-dot chain lines in FIG. 3) are integrated by soldering lands of a signal circuit (not shown) contained on the circuit board CB1 to the tail-shaped end portions 36 of the plurality of plug contacts 35 that project downwards below the fixed insulator 20 and by soldering the tail-shaped end portions 34 of the two fixing fittings 33 that project downwards below the fixed insulator 20 to lands of a ground circuit (not shown) contained on the circuit board CB1.

Figure 8:
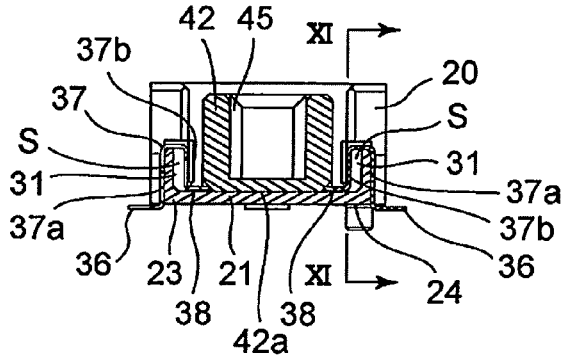
FIG. 8 is a cross sectional view taken along the VIII-VIII lines shown in FIG. 6, viewed in the direction of the appended arrows.
Figure 9:
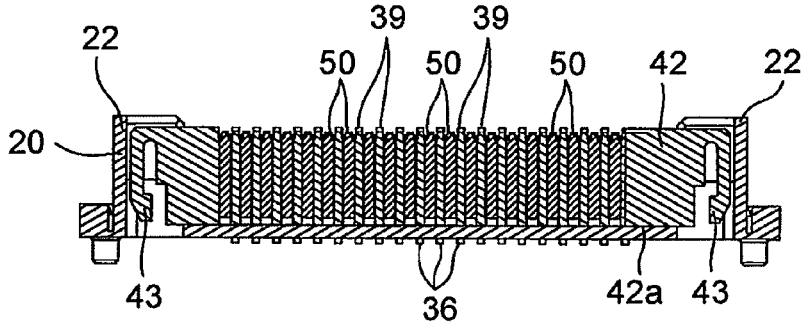
FIG. 9 is a cross sectional view taken along the XI-XI lines shown in FIG. 7, viewed in the direction of the appended arrows.
Figure 10:
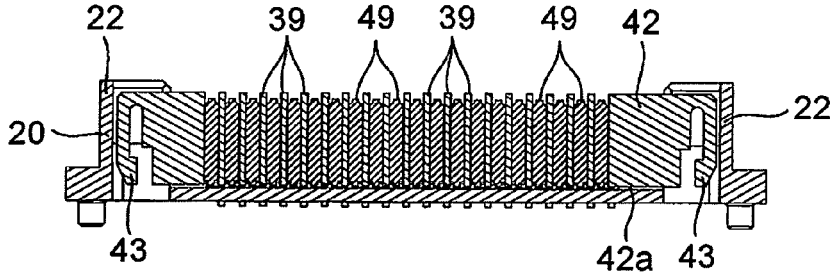
FIG. 10 is a cross sectional view taken along the X-X lines shown in FIG. 7, viewed in the direction of the appended arrows.
Figure 11:
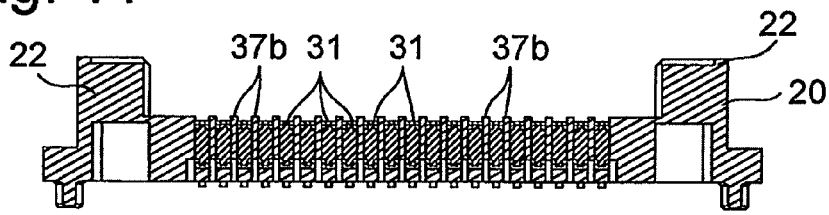
FIG. 11 is a cross sectional view taken along the lines XI-XI shown in FIG. 8, viewed in the direction of the appended arrows.
Figure 12:
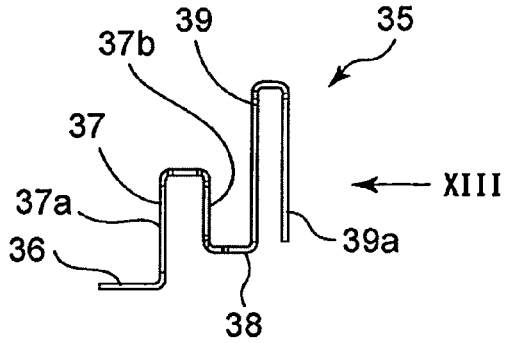
FIG. 12 is a side elevational view of a plug contact of the plug connector.

In addition, as shown in FIG. 8, each inner partition wall 31 is greater in length in the forward/rearward direction than the wall thickness (length in the forward/rearward direction) of the inner portion 37*b* of the fixed-side terminal portion 37 of each plug contact 35 and a gap S is formed between the inner portion 37*b* of the fixed-side terminal portion 37 of each plug contact 35 in the front row of plug contacts 35 and the front wall 23 and another gap S is formed between the inner portion 37*b* of the fixed-side terminal portion 37 of each plug contact 35 in the rear row of plug contacts 35 and the rear wall 24. Accordingly, the inner portion 37*b* of the fixed-side terminal portion 37 of each plug contact 35 becomes deformable in the associated gap S (this deformation of the inner portion 37*b* causes the intermediate portion 38 of the same plug contact 35 to also be resiliently deformed slightly in the forward/rearward direction) if the assembling jig (the guide pins thereof) is removed from the fixed insulator 20 and the movable insulator 42 (specifically from the left and right bottom through holes 25 and the left and right engaging holes 51). Therefore, the movable insulator 42, which is supported by the fixed insulator 20 via each plug contact 35, is slightly movable in the internal space of the fixed insulator 20 in the forward/rearward direction relative to the fixed insulator 20.

On the other hand, the fixed-side terminal portion 37 (and the intermediate horizontal portion 38) of each plug contact 35 is prevented from being resiliently deformed in the leftward/rightward direction because both side edges (left and right edges) of the fixed-side terminal portion 37 of each plug contact 35 are in contact with the adjacent outer and inner partition walls 30 and 31.

The detailed structure of the receptacle connector 60 will be hereinafter discussed with reference mainly to FIGS. 15 through 18.

The receptacle connector 60 is provided with a fixed insulator (second fixed insulator/first fixed insulator) 65, a pair of (left and right) fixing fittings 79, a large number of receptacle contacts (second contacts/first contacts) 83 and a movable insulator (second movable insulator/first movable insulator) 93 as relatively large elements of the receptacle connector 60.

The fixed insulator 65 is an integrally-molded element which is molded of an insulating and heat-resistant synthetic resin by injection molding. The fixed insulator 65 is in the shape of a box having an open bottom. The fixed insulator 65 is provided with a pair of (left and right) side walls 66, a front wall 67, a rear wall 68 and a center partition wall 69. Each of the pair of side walls 66 extends vertically downwards from portions of the top of the fixed insulator 65 in the vicinity of the left and right ends thereof, and the center partition wall 69 extends vertically downwards from a lower surface of the top of the fixed insulator 65 to partition the internal space of the fixed insulator 65 into front and rear spaces. The lower end of the front wall 67 except the left and right ends of this lower end is elongated vertically downwards beyond the positions of the lower ends of the pair of side walls 66 in the vertical direction, the lower end of the rear wall 68 (except the left and right ends thereof) is elongated vertically downwards beyond the positions of the lower ends of the pair of side walls 66 in the vertical direction, and the inner side surfaces of the elongated portions of the front wall 67 and the rear wall 68 are formed as front and rear limit surfaces 73, respectively, each of which extends in both the vertical direction and the leftward/rightward direction. The front wall 67 and the rear wall 68 are provided, on inner surfaces thereof immediately above the upper ends of the front and rear limit surfaces 73, with front and rear stepped portions 74, respectively, which extend in the leftward/rightward direction. The front wall 67 is provided at the left and right ends thereof with left and right engaging lugs 75 which project inwards, respectively. Likewise, the rear wall 68 is provided at the left and right ends thereof with left and right engaging lugs 75 which project inwards, respectively. In addition, the fixed insulator 65 is provided, in a portion thereof which extends across the upper end of the front wall 67 and the front end of the top of the fixed insulator 65, with a plurality of contact support grooves 77 which are formed at the same pitches (intervals) as the plurality of contact support grooves 29 in the leftward/rightward direction, and is further provided, in a portion thereof which extends across the upper end of the rear wall 68 and the rear end of the top of the fixed insulator 65, with another plurality of contact support grooves 77 which are formed at the same pitches (intervals) as the plurality of contact support grooves 29 in the leftward/rightward direction, so that there are two rows (front row and rear row) of contact support grooves 77. Each contact support groove 77 in the front row of contact support grooves 77 extends through the top and the front wall 67 of the fixed insulator 65 in the wall-thickness direction to communicatively connect the interior and external spaces of the fixed insulator 65. Likewise, each contact support groove 77 in the rear row of contact support grooves 77 extends through the top and the rear wall 67 of the fixed insulator 65 in the wall-thickness direction to communicatively connect the interior and external spaces of the fixed insulator 65.

The left and right fixing fittings 79 are press-formed products that are formed out of sheet metal (conductive materials). Each fixing fitting 79 is provided at the upper end thereof with a tail-shaped lug 80 which extends substantially horizontally.

The left and right fixing fittings 79 are fixedly fitted into left and right fitting fixing holes 71 formed on the fixed insulator 65, respectively, and the tail-shaped lugs 80 are positioned slightly above the top of the fixed insulator 65.

The plurality of receptacle contacts 83, which are identical in number to the plurality of contact support grooves 77, are each formed from a thin base material made of a resilient copper alloy (e.g., phosphor bronze, beryllium copper or titanium copper) or a resilient Corson-copper alloy and formed into the shape shown in the drawings by being bent in the direction of thickness of the thin base material after stamping is performed thereon using stamping dies in order, and is first nickel plated, as a base plating, and subsequently is gold plated, as a finish plating. As shown in the drawings, the plurality of receptacle contacts 83 are composed of two rows (front and rear rows) aligned in the leftward/rightward direction. The front row of receptacle contacts 83 and the rear row of receptacle contacts 83 are symmetrically arranged with respect to the forward/rearward direction. In addition, the thickness of each receptacle contact 83 is substantially identical to the width of each contact support groove 77 (and also the width of each of a plurality of contact insertion grooves 102 which will be discussed in detail later) in the leftward/rightward direction.

Each receptacle contact 83 is provided at the upper end thereof with a tail-shaped end portion 84 and further provided with a stationary portion 86, a resiliently deformable portion (second resiliently deformable portion) 87, an intermediate engaging portion 88, a vertically downwardly elongated portion 89 and a resilient contact portion 90. The stationary portion 86 is formed to be continuous with the tail-shaped end portion 84 and provided with an engaging groove 85 which is open downwards. The stationary portion 86 is shaped so that the length thereof in the forward/rearward direction is increasingly larger in the downward direction. The resiliently deformable portion 87 extends downwards from the lower end of the stationary portion 86. A through hole is formed through the resiliently deformable portion 87 to provide the resiliently deformable portion 87 with a pair of (front and rear) vertically-elongated narrow pieces on both sides of the through hole. The intermediate engaging portion 88 extends in the forward/rearward direction from the lower end of the resiliently deformable portion 87. The vertically downwardly elongated portion 89 is positioned closer to the core of the fixed insulator 65 than the inner part of the resiliently deformable portion 87 in the forward/rearward direction and extends downwards from the lower end of the intermediate engaging portion 88. The resilient contact portion 90 is resiliently deformable in the forward/rearward direction and extends obliquely upwards from the lower end of the vertically downwardly elongated portion 89.

Figure 19:
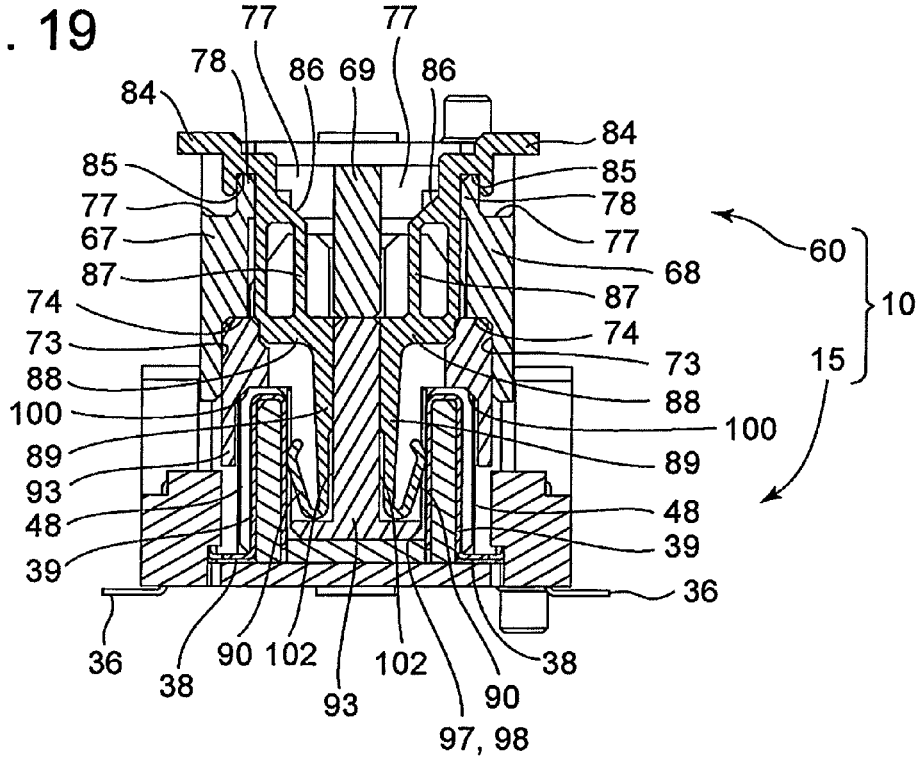
FIG. 19 is a cross sectional view taken along the lines XIX-XIX shown in FIG. 3, viewed in the direction of the appended arrows.
Figure 20:
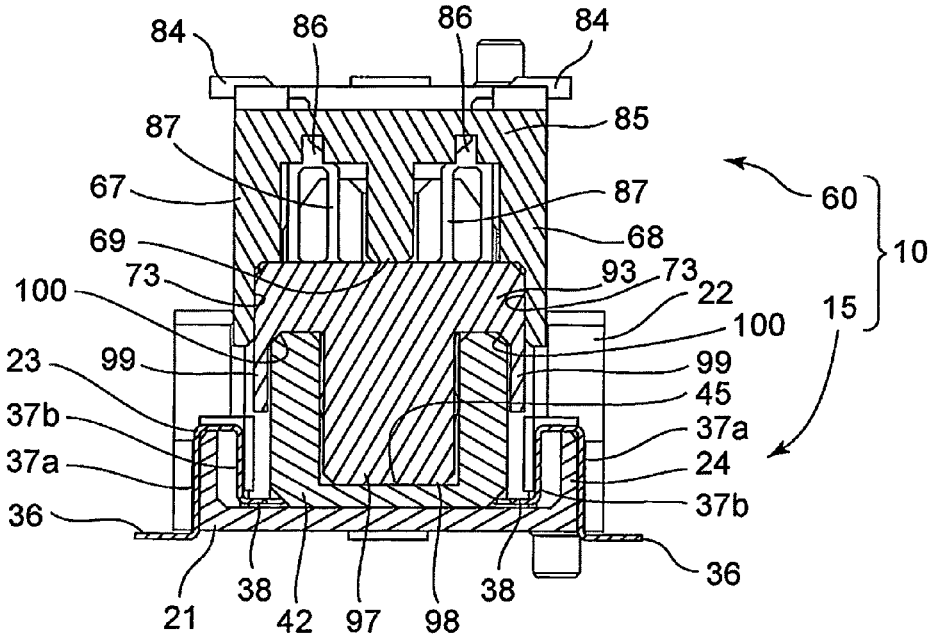
FIG. 20 is a cross sectional view taken along the lines XX-XX shown in FIG. 3, viewed in the direction of the appended arrows.
Figure 21:
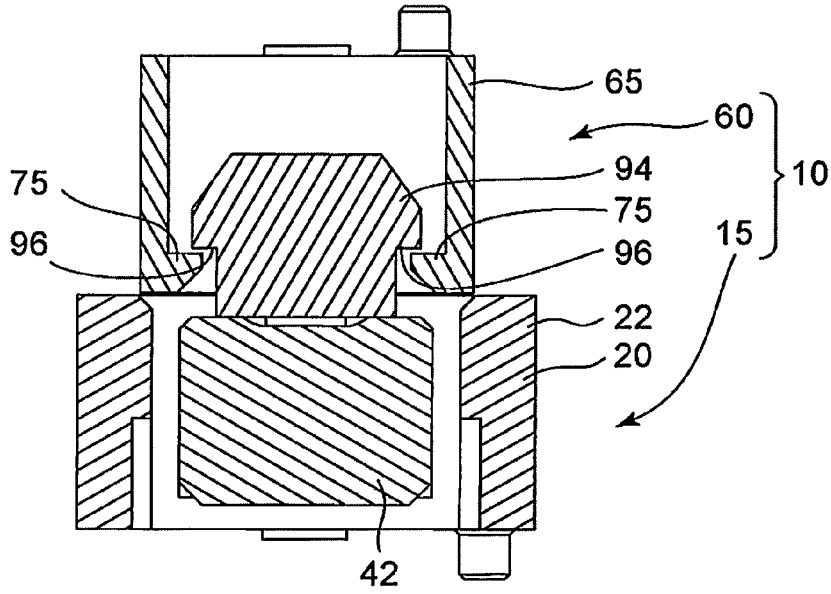
FIG. 21 is a cross sectional view taken along the lines XXI-XXI shown in FIG. 3, viewed in the direction of the appended arrows.

The plurality of receptacle contacts 83 are inserted (engaged) into the plurality of contact support grooves 77 of the fixed insulator 65 from above, respectively. As shown in FIG. 19, when one receptacle contact 83 is inserted into one contact support groove 77, the stationary portion 86 of the receptacle contact 83 is positioned in the contact support groove 77; thereupon, the engaging groove 85 of each receptacle contact 83 is engaged with associated one of a pair of (front and rear) locking projections 78, each of which projects upwards from an inner surface of the fixed insulator 65 in the contact support groove 77, so that each receptacle contact 83 is fixed to the associated locking projection 78 via the engaging groove 85 of the receptacle contact 83. Accordingly, the receptacle contacts 83 are cantilevered by the fixed insulator 65 via the engaging grooves 85 of the receptacle contacts 83 and the locking projections 78 of the contact support grooves 77. The resiliently deformable portion 87, the intermediate engaging portion 88 and an upper half of the vertically downwardly elongated portion 89 of each receptacle contact 83 are positioned in an internal space of the fixed insulator 65, while a lower half of the vertically downwardly elongated portion 89 and the resilient contact portion 90 of each receptacle contact 83 project downwards from the lower end of the fixed insulator 65.

The movable insulator (second movable insulator/first movable insulator) 93 is an integrally-molded element which is molded of an insulating and heat-resistant synthetic resin by injection molding.

The movable insulator 93 is provided, on top thereof at the left and right ends of the movable insulator 93, with a pair of (left and right) upper projections 94 which project upwards, respectively. The movable insulator 93 is provided on inner side surfaces of the left and right upper projections 94 with left and right receiving grooves 95 which are recessed leftward and rightward, respectively, and is provided, at the front and rear ends of the lower end of each upper projection 94, with a pair of (front and rear) lower engaging grooves 96, respectively. A lower half of the movable insulator 93 is provided with a central projection 97 which projects downwards, and the bottom of the central projection 97 is formed as a flat horizontal contact surface 98. In addition, the movable insulator 93 is provided with a pair of (front and rear) limit plates 99 which extend parallel to each other in both the vertical direction and the leftward/rightward direction and which are spaced forward and rearward from the front and rear surfaces of the central projection 97, respectively. The movable insulator 93 is further provided, at the upper end of the inner side surface of each limit plate 99, with a stepped portion 100 (see FIGS. 19 and 20) which extends in the leftward/rightward direction. The movable insulator 93 is further provided with a pair of (left and right) engaging projections 101, respectively, which project downwards to positions below the horizontal contact surface 98 in the vertical direction.

The movable insulator 93 is provided on a top surface thereof with two rows (front row and rear row) of contact insertion grooves 102 which are formed to correspond to the two rows of contact support grooves 77 at the same intervals as the two rows of the contact support grooves 29 (contact support grooves 77). A lower part of each contact insertion groove 102 is open on both front and rear surfaces of the central projection 97 (see FIGS. 15 and 19).

The movable insulator 93 is integrated with the fixed insulator 65 and each receptacle contact 83 by bringing the upper part of the movable insulator 93 into an internal space of the fixed insulator 65 from below. Namely, upon the top of the movable insulator 93 being inserted into an internal space of the fixed insulator 65, the left and right ends of the central partition wall 69 of the fixed insulator 65 are engaged in the left and right receiving grooves 95, respectively, the front and rear edges of an upper portion of the movable insulator 93 (an upper portion of the movable insulator 93 which is positioned between the left and right upper projections 94) come in contact with the front and rear stepped portions 74 (see FIG. 19) of the fixed insulator 65, respectively, and each engaging lug 75 is engaged in the associated lower engaging groove 96 from below (see FIG. 21). Accordingly, the movable insulator 93 is prevented from unintentionally coming off downwardly from the internal space of the fixed insulator 65. In addition, since the front and rear limit plates 99 face the front and rear limit surfaces 73 of the adjacent front and rear walls 67 and 68, respectively, the movable insulator 93 is prevented from moving in the forward/rearward direction relative to the fixed insulator 65. In addition, a lower half of the vertically downwardly elongated portion 89 and the resilient contact portion 90 of each receptacle contact 83 enter the associated contact insertion groove 102, which causes the intermediate engaging portion 88 of each receptacle contact 83 to be engaged with an inner surface of the movable insulator 93 (the associated contact insertion groove 102) and causes an inner side surface of the upper half of the vertically downwardly elongated portion 89 of each receptacle contact 83 to come in contact with an inner surface of the associated contact insertion groove 102 (see FIG. 19).

After the fixed insulator 65, the plurality of receptacle contact 83 and the movable insulator 93 are put together to comprise the receptacle connector 60 in the above described manner, the receptacle connector 60 and a circuit board CB2 (shown by two-dot chain line in FIG. 3) are integrated by soldering lands of a signal circuit (not shown) contained on the circuit board CB2 to the tail-shaped end portions 84 of the plurality of receptacle contacts 83 that project upwards from a top surface of the fixed insulator 65 and by soldering the tail-shaped lugs 80 of the plurality of fixing fittings 79 that project upwards from the top surface of the fixed insulator 65 to lands of a ground circuit (not shown) contained on the circuit board CB2.

In the receptacle connector 60, the movable insulator 93 is prevented from moving in the forward/rearward direction relative to the fixed insulator 65 because the front and rear limit plates 99 are prevented from moving in the forward/rearward direction by the front and rear limit surfaces 73 that face the front and rear limit plates 99, respectively.

Figure 18:
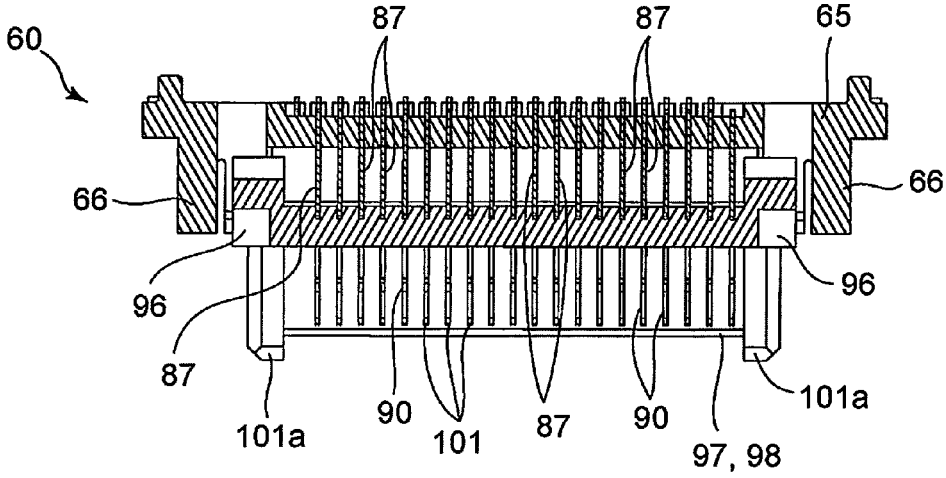
FIG. 18 is a cross sectional view taken along the lines XVIII-XVIII shown in FIG. 17, viewed in the direction of the appended arrows.

Additionally, as shown in FIGS. 18 and 19, since the resiliently deformable portion 87 of each receptacle contact 83 is positioned in the internal space of the fixed insulator 65 that is partitioned into front and rear spaces by the center partition wall 69, the resiliently deformable portion 87 of each receptacle contact 83 is resiliently deformable in this internal space of the fixed insulator 65 in the leftward/rightward direction. Therefore, the movable insulator 93, which is supported by the fixed insulator 65 via each receptacle contact 83, can slightly move in the leftward/rightward direction relative to the fixed insulator 65 in the internal space thereof.

On the other hand, since the stationary portion 86 of each receptacle contact 83 is prevented from moving in the forward/rearward direction by the engagement between the associated locking projection 78 and the engaging groove 85 of the receptacle contact 83 and since the intermediate engaging portion 88 is prevented from moving in the forward/rearward direction by engagement with an inner surface of the associated contact insertion groove 102, the resiliently deformable portion 87 of each receptacle contact 83 cannot substantially be resiliently deformed in the forward/rearward direction, and therefore, the movable insulator 93 does not move in the forward/rearward direction relative to the fixed insulator 65.

The plug connector 15 and the receptacle connector 60 of the connector 10 that are configured as described above are mutually connected (engaged with each other) in a procedure which will be discussed hereinafter.

Figure 2:
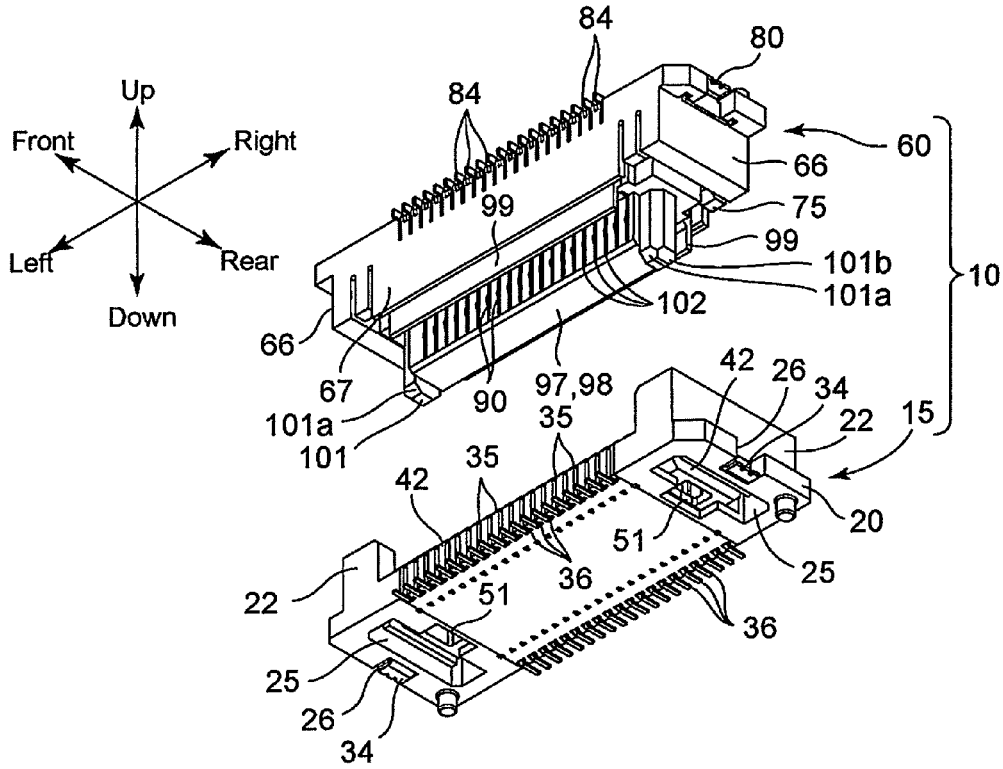
FIG. 2 is a bottom perspective view of the connector, showing the plug connector and the receptacle connector thereof in a disconnected state.
Figure 3:
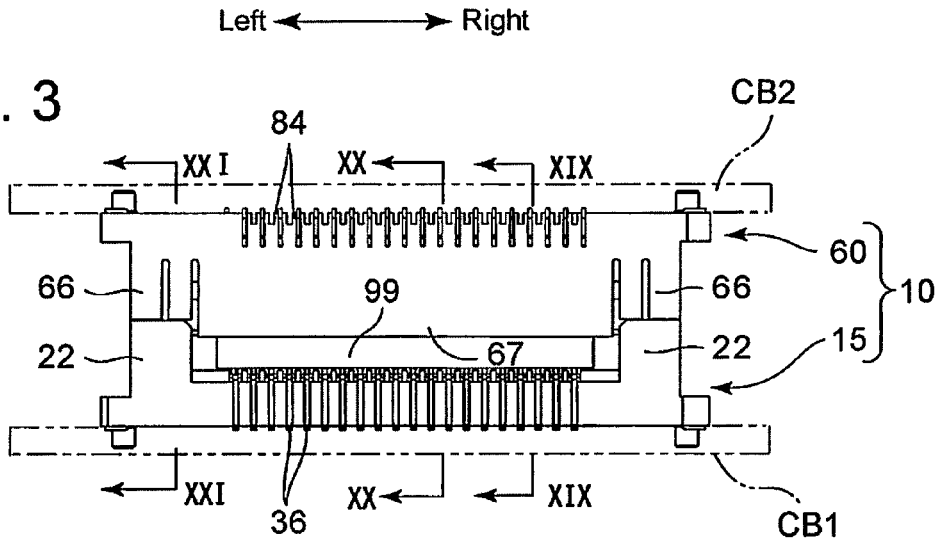
FIG. 3 is a side elevational view of the connector in a connected state.
Figure 4:
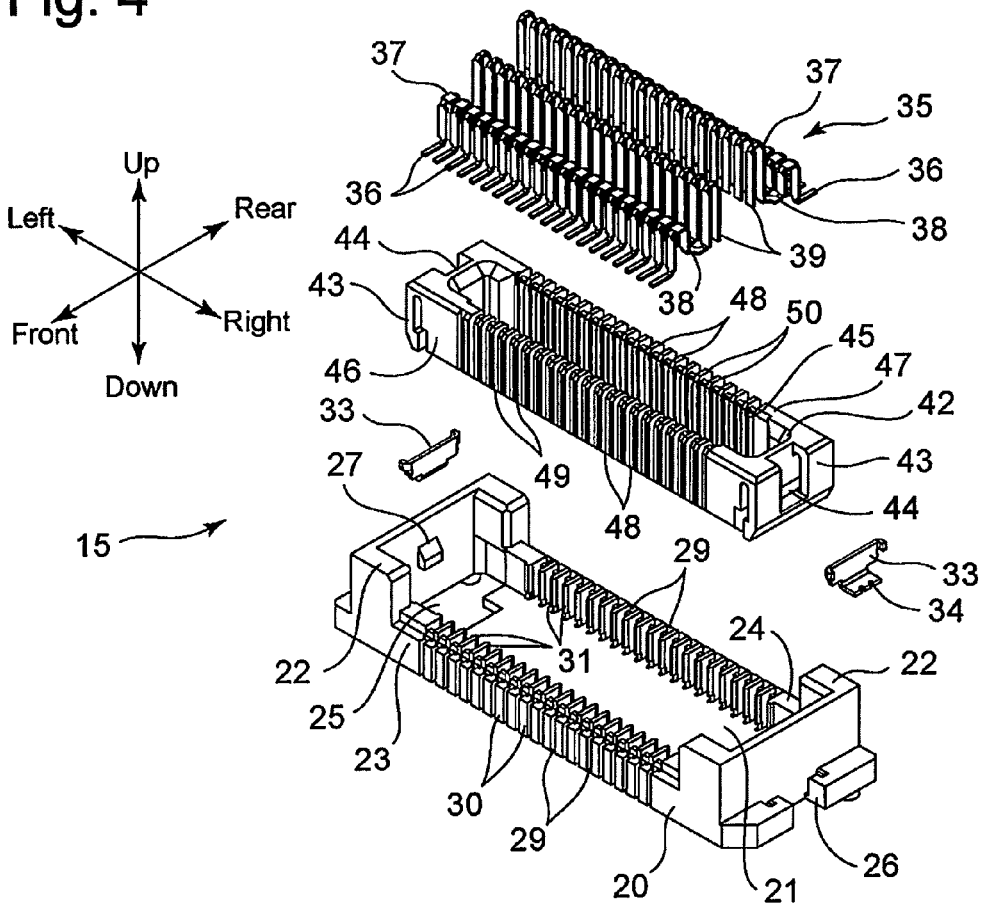
FIG. 4 is an exploded top perspective view of the plug connector of the connector.
Figure 5:
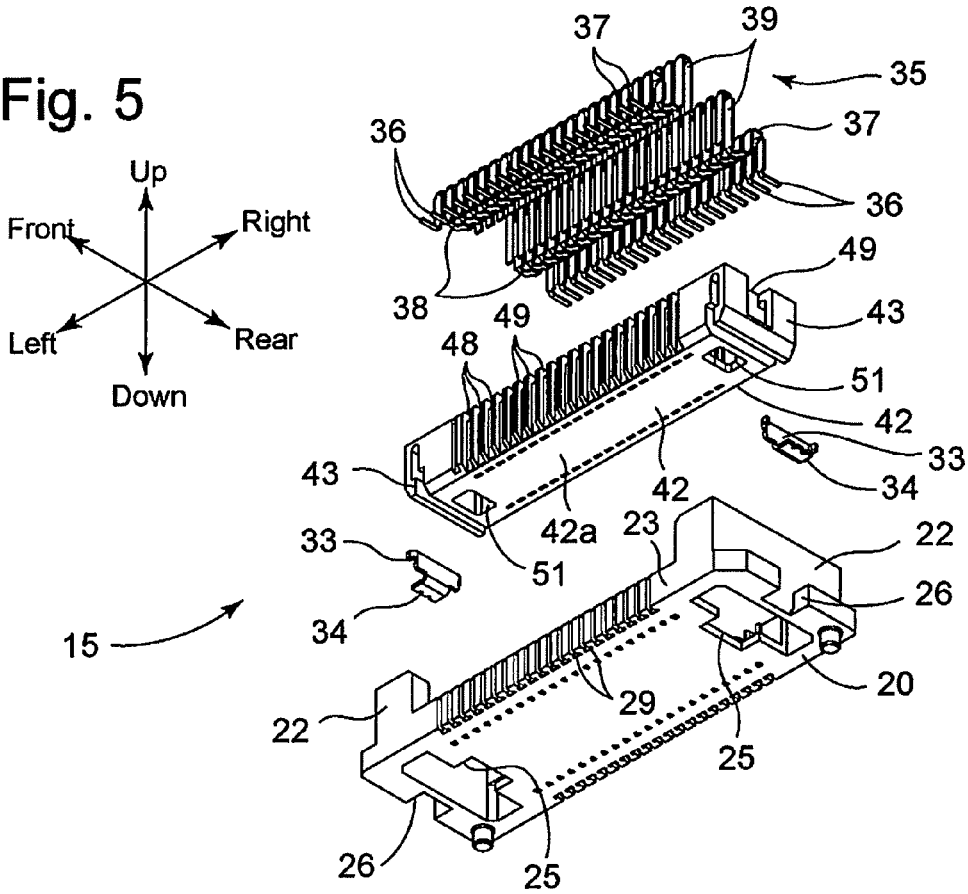
FIG. 5 is an exploded bottom perspective view of the plug connector of the connector.
Figure 6:
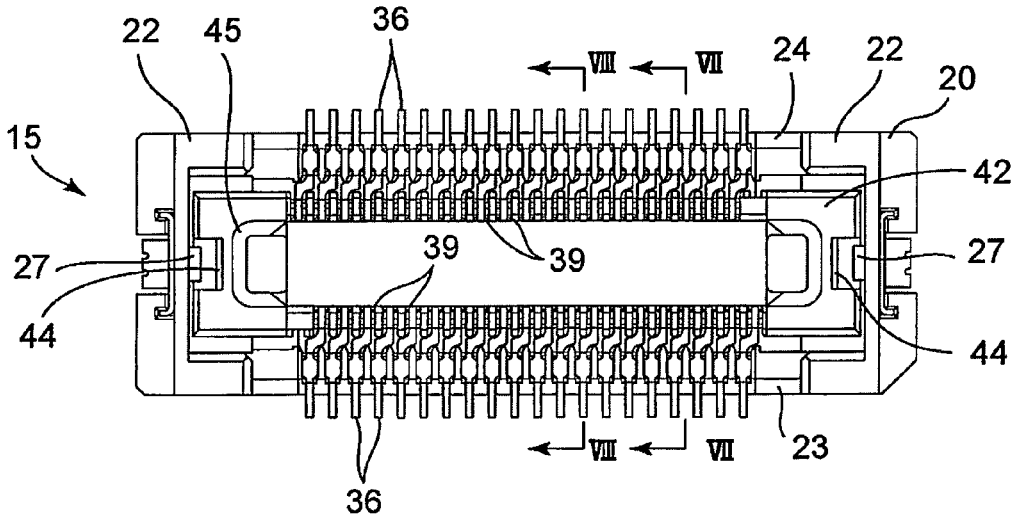
FIG. 6 is a plan view of the plug connector of the connector.
Figure 22:
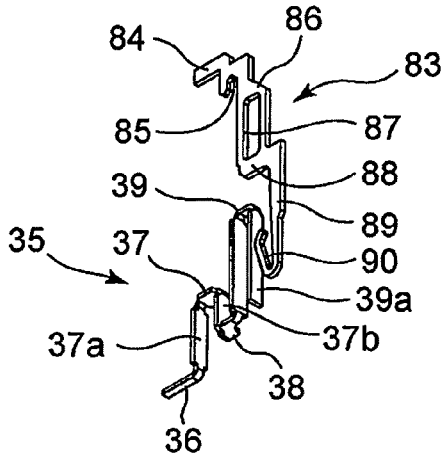
FIG. 22 is a perspective view of a plug contact of the plug connector and a receptacle contact of the receptacle connector in a mutually contacted state.

First, the center axes of the plug connector 15 and the receptacle connector 60, separated from each other in the vertical direction as shown in FIG. 2, which extend in the vertical direction are brought into coincident with each other, and thereafter, the plug connector 15 and the receptacle connector 60 are linearly brought together (along the vertical direction, or an approaching direction). Thereupon, the left and right engaging projections 101 and the central projection 97 are smoothly engaged in the receiving recess 45, so that the horizontal contact surface 98 of the central projection 97 comes into contact with the bottom of the receiving recess 45 (see FIG. 19), upper surfaces of the two support walls 22 and lower surface of the two side walls 66 come in surface contact with each other, respectively, and the left and right engaging projections 101 of the receptacle connector 60 are smoothly engaged in the left and right engaging holes 51 and the left and right through holes 25 of the movable insulator 42, respectively. In addition, the stepped portions 100 of the front and rear limit plates 99 are smoothly engaged with the front and rear edges of the upper end of the movable insulator 42, respectively. Additionally, the resilient contact portion 90 of each receptacle contact 83, which has entered the receiving recess 45 of the movable insulator 42, comes in contact with a contact portion 39*a* (which is an inner side portion (right-hand side portion with respect to FIG. 12) of the support-side terminal portion 39) of the associated plug contact 35 while being resiliently deformed (see FIG. 22. The width of the contact portion 39*a* in the leftward/rightward direction is greater than the thickness of the resilient contact portion 90 in the same direction as shown in FIG. 22), and accordingly, the circuit board CB1 and the circuit board CB2 are electrically connected via each plug contact 35 and each receptacle contact 83.

On the other hand, if the vertically-extending central axes of the plug connector 15 and the receptacle connector 60 deviate from each other to some extent, in a separated (disconnected) state, in the forward/rearward direction and/or the leftward/rightward direction before the plug connector 15 and the receptacle connector 60 are connected to each other, the plug connector 15 and the receptacle connector 60 are connected together in a manner which will be discussed hereinafter.

In this case, the left and right engaging projections 101 of the receptacle connector 60 are not smoothly engaged in the receiving recess 45 of the movable insulator 42, and beveled guide surfaces 101*a*, which are respectively formed on the front and rear lower edges of each of the left and right engaging projections 101 so that the lower end of each engaging projections 101 tapers downwardly, come in contact with front and rear edges of the upper end of the movable insulator 42, and therefore, a force urging the movable insulator 42 to move in the forward/rearward direction is exerted on the movable insulator 42 by the receptacle connector 60. Thereupon, the inner portion 37*b* of the fixed-side terminal portion 37 (and also the intermediate horizontal portion 38) of each plug contact 35 that supports the movable insulator 42 is slightly resiliently deformed in the forward/rearward direction, and this resilient deformation causes the movable insulator 42 to move (floatingly) forward or rearward relative to the fixed insulator 20 to thereby make the positions of the aforementioned center axes of the receptacle connector 60 (the movable insulator 93) and the movable insulator 42 coincide with each other in the forward/rearward direction. Moreover, in this case, beveled guide surfaces 101*b* which are formed on the left lower edge of the left engaging projection 101 and the right lower edge of the right engaging projection 101, respectively, come in contact with left and right edges of the upper end of the movable insulator 42, and therefore, a force urging the movable insulator 93 to move in the leftward/rightward direction is exerted on the movable insulator 93 by the receptacle connector 60. Thereupon, the resiliently deformable portion 87 of each receptacle contact 83 that supports the movable insulator 93 is slightly resiliently deformed in the leftward/rightward direction, and this resilient deformation causes the movable insulator 93 to slightly move leftward or rightward (floatingly) relative to the fixed insulator 65 to thereby make the positions of the aforementioned center axes of the receptacle connector 60 (the movable insulator 93) and the movable insulator 42 coincide with each other in the leftward/rightward direction.

After the center axes of the receptacle connector 60 (the movable insulator 93) and the movable insulator 42 coincide with each other in both the forward/rearward direction and the leftward/rightward direction in the above described manner, the plug connector 15 and the receptacle connector 60 are mutually connected while the resilient contact portion 90 of each receptacle contact 83 comes in contact (engagement) with the aforementioned inner side portion of the support-side terminal portion 39 of the associated plug contact 35 in the same way as described above.

In addition, if the circuit board CB1 and the circuit board CB2 deviate from each other in the forward/rearward direction and/or the leftward/rightward direction after the plug connector 15 and the receptacle connector 60 are connected to each other, this deviation is absorbed (canceled) by a resilient deformation of each plug contact 35 and each receptacle contact 83 in the forward/rearward direction and the leftward/rightward direction, so that the connected state between each plug contact 35 and the associated receptacle contact 83 is securely maintained.

In this manner, in the present embodiment of the connector, the positional deviation between the plug connector 15 and the receptacle connector 60 in the forward/rearward direction is absorbed by the plurality of plug contacts 35 on the plug connector 15 side, and the positional deviation between the plug connector 15 and the receptacle connector 60 in the rightward/leftward direction is absorbed by the plurality of receptacle contacts 83 on the receptacle connector 60 side.

Since the direction of absorption of the positional deviation of the plug connector 15 with respect to the receptacle contact 60 is limited to one axial direction (the forward/rearward direction) in the above-described manner, the inner partition walls 31, which limit resilient deformation of movable parts (the inner portion 37*b* of the fixed-side terminal portion 37, and the intermediate horizontal portion 38) of each plug contact 35 in the leftward/rightward direction (being a major cause of fluctuations in impedance upon occurrence of positional deviation) and are higher in relative permittivity than air (the relative permittivity of air=1), can be installed in the plug connector 15. Therefore, the impedance can be adjusted easily by, e.g., optimization (design change) of the spacing between each plug contact 35 and the adjacent inner partition walls 31 and the shape of each inner partition wall 31; moreover, the impedance can be easily stabilized even when a positional deviation occurs between the plug connector 15 and the receptacle connector 60. Additionally, although the outer partition walls 30, the outer partition walls 49 and the inner partition walls 50 are portions having the capability of supporting the plurality of plug contacts 35 and insulating adjacent plug contacts 35 of the plurality of plug contacts 35 from each other, these portions can also be given an impedance adjustment capability by optimizing the shapes of these portions.

Moreover, since the inner portion 37*b* of the fixed-side terminal portion 37 and the intermediate horizontal portion 38 of each plug contact 35 only need to be resiliently deformed in the forward/rearward direction, an increase in width of the inner portion 37*b* of the fixed-side terminal portion 37 and the intermediate horizontal portion 38 of each plug contact 35 in the leftward/rightward direction makes it possible to increase the cross sectional area of each of the inner portion 37*b* and the intermediate horizontal portion 38 to be greater than that in a comparative case where the inner portion 37*b* and the intermediate horizontal portion 38 of each plug contact 35 are resiliently deformable in both the forward/rearward direction and the leftward/rightward direction. This makes it possible to achieve a reduction in conductor resistance of each plug contact 35, thus making it possible to improve the transmission characteristics. Thus, each plug contact 35 is a member which is relatively large in width in the leftward/rightward direction and resiliently deformable in the forward/rearward direction (direction of the contact thickness), and accordingly, it is desirable for each plug contact 35 to be made as a spring member shaped by bending a planar base metal material in the direction of thickness thereof in a like manner to that in the above described embodiment.

Additionally, as shown in FIG. 14, each plug contact 35 of the plug connector has a crank structure in which the tail-shaped end portion 36 and the support-side terminal portion 39 thereof are displaced from each other in the direction of alignment of each row of the plug contacts 35 by a distance corresponding to half (half pitch: the distance between points A1 and B1 in the leftward/rightward direction; the distance between points A2 and B2 in the leftward/rightward direction) the interval between adjacent plug contacts 35 in the leftward/rightward direction (one pitch: the distance between points A1 and A2 in the leftward/rightward direction; the distance between points B1 and B2 in the leftward/rightward direction). Due to this crank structure, it is possible to attain the following advantages which will be discussed hereinafter.

Although an intimate relationship exists between the impedance of the connector and the distance between opposed surfaces of adjacent contacts of the connector, the contact pitch is defined by external factors such as a terminal pitch of an external apparatus and a layout of a circuit board, both of which are connected to the connector, and it is sometimes the case that the contact pitch defined based on such external factors may cause an increase of the impedance of the connector. In general, the impedance of the connector decreases as the distance between opposed surfaces of conductors (contacts) of the connector is smaller. Therefore, in the case where the impedance of the connector increases due to an external factor, the aforementioned distance between opposed surfaces of adjacent contacts of the connector only need to be reduced without changing the contact pitch. As an example of achieving this objective, a means for widening the width of each contact can be provided to reduce the distance between opposed surfaces of adjacent contacts of the connector. However, in the case of a floating connector, contacts thereof become difficult to deform resiliently if the contact width is excessively increased, so that the floating operation of the connector (floating connector) becomes stiff. In contrast, if each contact is shaped to have a crank structure like each plug contact 35 of the above described embodiment of the connector 10 according to the present invention, the distance between opposed surfaces of adjacent contacts (the distance between adjacent points C shown in FIG. 14) can be reduced with the contact width remaining at a contact width optimal for the floating operation.

Since the resiliently deformable portion 87 of each receptacle contact 83 that is positioned between the associated stationary portion 86 (which is prevented from moving in the forward/rearward by the engagement between one locking projection 78 and the associated engaging groove 85 of the receptacle contact 83) and the intermediate engaging portion (which is prevented from moving in the forward/rearward direction by engagement with an inner surface of the associated contact insertion groove 102) is resiliently deformable in the leftward/rightward direction in the receptacle connector 60, the receptacle connector 60 can securely absorb positional deviation (floating) of the movable insulator 93 with respect to the fixed insulator 65.

In addition, when the inner portion 37*b* and the intermediate horizontal portion 38 of each plug contact 35, which are movable parts of each plug contact 35, are resiliently deformed in the forward/rearward direction, the inner portion 37*b* and the intermediate horizontal portion 38 of each plug contact 35 are resiliently deformed slightly in the vertical direction also, and accordingly, the plug contact 35 can also absorb a rotational deviation of the movable insulator 42 with respect to the fixed insulator 20 in a plane orthogonal to the leftward/rightward direction. Likewise, when the resiliently deformable portion 87, which is a movable part of each receptacle contact 60, is resiliently deformed in the leftward/rightward direction, the resiliently deformable portion 87 is resiliently deformed slightly in the vertical direction also, and accordingly, the receptacle contact 60 can also absorb a rotational deviation of the movable insulator 93 with respect to the fixed insulator 65 in a plane orthogonal to the forward/rearward direction.

Upon the plug connector 15 and the receptacle connector 60 being connected to each other, the movable insulator 42 and the movable insulator 93 are engaged with each other. Moreover, since the resilient contact portion 90 of each receptacle contact 83 is prevented from moving in the leftward/rightward direction by the associated contact insertion groove 102, the resilient contact portion 90 of each receptacle contact 83 securely holds the posture thereof with respect to the contact portion 39*a* of the support-side terminal portion 39 of the associated plug contact 35 (i.e., the resilient contact portion 90 of each receptacle contact 83 is neither inclined nor twisted accidentally). Therefore, even if a positional deviation occurs between the movable insulator 42 and the fixed insulator 20 or between the movable insulator 93 and the fixed insulator 65, a contact state between each plug contact 35 and the associated receptacle contact 83 is maintained.

In addition, since each receptacle contact 83 is formed by stamping out sheet metal in like manner to that of each plug contact 35 so that the resiliently deformable portion 87 thereof is resiliently deformable in the direction of the thickness thereof, each receptacle contact 83 can be resiliently deformed easily in the leftward/rightward direction. Moreover, the conductor width of the resiliently deformable portion 87 of each receptacle contact 83 can be increased as compared with the case where the resiliently deformable portion 87 is formed to be resiliently deformable in a direction orthogonal to the thickness thereof, which is advantageous also for transmission characteristics. Furthermore, deformation load of the resiliently deformable portion 87 can be adjusted by changing the shape design of the hole formed through the center of the resiliently deformable portion 87.

Although the present invention has been described based on the above illustrated embodiment of the contact, the present invention is not limited solely to this particular embodiment; various modifications to the above illustrated embodiment of the contact are possible.

For instance, the direction of deformation of each contact on the plug connector 15 and the direction of deformation of each contact on the receptacle connector 60 can be reversed.

Figure 23:
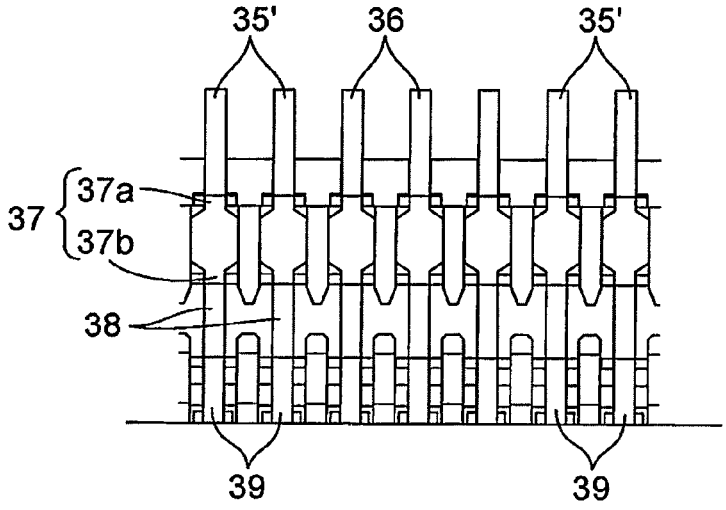
FIG. 23 is a view similar to that of FIG. 14, showing a modified embodiment.

In addition, as shown in FIG. 23, each contact 35' (which corresponds to each plug contact 35 and is identical in profile shape to each plug contact 35) can be formed into a linear shape in plan view.

Additionally, the resiliently deformable portion 87 (linear portion) of each receptacle contact 83 can be composed of a single narrow piece or more than two narrow pieces.

Additionally, the resiliently deformable portion 87 of each receptacle contact 83 can be made to be resiliently deformable more easily in the leftward/rightward direction by forming a minute clearance in the leftward/rightward direction between the vertically downwardly elongated portion 89 of each receptacle contact 83 and the associated contact insertion groove 102.

Additionally, the support-side terminal portion 39 can be made to be resiliently deformable in the forward/rearward direction instead of the fixed-side terminal portion 37.

Obvious changes may be made in the specific embodiments of the present invention described herein, such modifications being within the spirit and scope of the invention claimed. It is indicated that all matter contained herein is illustrative and does not limit the scope of the present invention.

What is claimed is:

1. A connector having a plug connector and a receptacle connector which are connected to and disconnected from each other by linearly moving said plug connector and said receptacle connector toward and away from each other along an approaching/retreating direction, respectively, wherein one of said plug connector and said receptacle connector comprises:

a first fixed insulator;

first contacts which are cantilevered by said first fixed insulator in a state of being aligned in a first direction orthogonal to said approaching/retreating direction and each of which includes a first resiliently deformable portion deformable in a second direction orthogonal to both said approaching/retreating direction and said first direction;

a first movable insulator supported by free ends of said first contacts; and partition walls formed on at least one of said first fixed insulator and said first movable insulator to be positioned between adjacent said first resiliently deformable portions of said first contacts, and wherein the other of said plug connector and said receptacle connector comprises:

a second fixed insulator;

second contacts which are cantilevered by said second fixed insulator in a state of being aligned in said first direction, each of which includes a second resiliently deformable portion that is deformable in said first direction and is contactable with associated one of said first contacts; and a second movable insulator which is supported by free ends of said second contacts and engaged with said first movable insulator when said first contacts and said second contacts come in contact with each other.

2. The connector according to claim 1, wherein said partition walls prevent adjacent said first resiliently deformable portions from being resiliently deformed in said first direction.

3. The connector according to claim 1, wherein said second contacts are each formed by stamping out sheet metal, and wherein said second resiliently deformable portion of each of said second contacts is resiliently deformable in the sheet-metal thickness direction thereof.

4. The connector according to claim 1, wherein said first contacts are each formed by stamping out a sheet metal, and wherein said first resiliently deformable portion of each of said first contacts is resiliently deformable in the sheet-metal thickness direction thereof.

5. The connector according to claim 1, wherein said second contacts are each formed by stamping out sheet metal, and wherein resilient contact portions, which are formed on said second contacts and come into contact with contact portions formed on said first contacts when said first movable insulator and said second movable insulator are engaged with each other, are resiliently deformable in a direction orthogonal to the sheet-metal thickness direction thereof.

6. The connector according to claim 5, wherein said contact portions, which are formed on said first contacts and come into contact with said resilient contact portions of said second contacts when said first movable insulator and said second movable insulator are engaged with each other, are greater in width than said resilient contact portions, respectively.

* * * * *